United States Patent [19]

Stinton

[11] 4,255,104

[45] Mar. 10, 1981

[54] SYSTEM FOR CASTING AND HANDLING CONCRETE RAILROAD TIES

[75] Inventor: Frederick M. Stinton, Woodbridge, Canada

[73] Assignee: Martin Concrete Engineering Company, Fort Worth, Tex.

[21] Appl. No.: 12,609

[22] Filed: Feb. 16, 1979

Related U.S. Application Data

[60] Continuation-in-part of Ser. No. 933,283, Aug. 14, 1978, which is a division of Ser. No. 928,697, Jul. 27, 1978.

[51] Int. Cl.[3] ..... B28B 23/06

[52] U.S. Cl. ..... 425/111; 264/70; 264/228

[58] Field of Search ..... 264/228, 70; 425/111

[56] References Cited

U.S. PATENT DOCUMENTS 4,102,957 7/1978 DaRe ..... 425/111 X

*Primary Examiner*—Thomas P. Pavelko

*Attorney, Agent, or Firm*—Hubbard, Thurman, Turner, Tucker & Glaser

[57] ABSTRACT

Concrete railroad crossties are mass-produced by slip-forming concrete using a specially adapted continuous casting machine to deposit concrete over a plurality of forms arranged side by side and end to end above an elongated casting bed. Each group of side-by-side casting forms is supported above the bed on a carriage longitudinally moveable on rollers, thereby permitting relative movement of adjacent end-to-end carriages to compensate for concrete contraction when pretensioned wire strands in the concrete are detensioned and for a slight recoil action when adjacent end-to-end crossties are separated by sawing. An apparatus for lifting side-by-side crossties in groups is equipped with hydraulic jacks for forcibly ejecting the concrete crossties from their forms.

11 Claims, 11 Drawing Figures

SYSTEM FOR CASTING AND HANDLING CONCRETE RAILROAD TIES

BACKGROUND OF THE INVENTION

1. Cross Reference to Related Application

This application is a continuation-in-part of commonly assigned application Ser. No. 933,283, filed Aug. 14, 1978 which in turn is a division of Application Ser. No. 928,697, filed July 27, 1978.

2. Field of the Invention

The present invention pertains to high volume concrete casting and handling techniques, and more particularly to improved techniques for slip-forming prestressed concrete railroad ties.

It is a general object of the present invention to provide a system that overcomes the limitations of the prior art that have effectively prevented the mass production of concrete railroad crossties by slip-forming.

3. Description of the Prior Art

The prestressed concrete crosstie for supporting rails has found wide acceptance in the railroad industry as a substitute for the traditional wooden railroad tie. Until now, however, there has been only limited success in adapting state-of-the-art techniques for mass production of concrete crossties. Although casting by slip-forming has become common in the production of prestressed concrete products having regular cross-sectional shapes such as building panels and structural beams and columns, slip-forming of the industry standard concrete crosstie has not yet been widely attempted. Rather, it is still the predominant practice in the industry to manufacture concrete crossties using conventional wet casting techniques wherein concrete is poured into molds of the desired shape.

Those skilled in the art will appreciate that slip-forming provides many advantages over such conventional wet casting techniques. Wet casting requires full forms around the sides and ends of the concrete product, thereby not only adding to the cost, but also tending to allow air bubbles and voids to form along the sides of the product. Slip-forming, on the other hand, employs moving side forms which tend to eliminate air bubbles and voids by virtue of the traveling effect of the form along the sides of the product being cast.

When the product being cast is a crosstie, prestressed cables must be employed, thus requiring bulkheads and seals at the ends of each form or mold used in a wet cast process. Slip-forming of concrete crossties, however, permits the elimination of bulkheads since the crossties are formed continuously end to end and later separated by sawing. In addition to the very favorable economic advantages of mass-producing crossties by slip-forming, those skilled in the art will appreciate that a number of practical benefits are also derived from the continuous end-to-end formation. For example, in conventional wet casting systems using full forms for each crosstie, an undesirable sieving effect occurs at the ends of the crossties such that concrete tends to squirt through the spaces around the prestressed cables within the endwalls of the forms. Such sieving action adversely affects the integrity of the concrete at the ends of the crossties where the best possible concrete is required for forming a good bond with the prestressed cables. Such deficient bonds are eliminated by the present method of continuous end-to-end formation and separation by sawing.

An additional advantage of slip-forming is that the very high strength requirements needed for concrete crossties are more readily achieved using low slump concrete which can readily be slip-formed but is difficult to wet cast due to its relatively low water content.

From experience with the system described in the above-referenced application, it has been found that the forms or molds upon which the crossties are slip-formed have a tendency to move by a small but significant amount both upon the detensioning of the prestressed cables at the ends of the casting bed and upon separating adjacent end-to-end crossties by sawing. It has also been found that resistance to the movement of the forms can damage the forms as well as the crossties themselves. Furthermore, uncontrolled movement of the forms makes their realignment for the next casting operation more difficult and time consuming. Accordingly, it is a particular object of the present invention to provide a technique for eliminating the resistance to the relative movement of adjacent end-to-end forms over short distances during the detensioning and sawing steps of the process while maintaining general alignment of the forms on the casting bed.

Another area of difficulty in the system described in the above-referenced application concerns the task of removing finished crossties from their forms. It has been found to be difficult and very awkward to remove the concrete crossties from their forms due to the tendency of the concrete to stubbornly adhere to the surfaces of the forms even when a release agent has been used. Accordingly, it is another particular object of the present invention to provide a technique for quickly removing crossties side by side in groups from their forms for transport to a stacking area or the like without dislocating or damaging the forms.

SUMMARY OF THE INVENTION

These and other objects and advantages are accomplished in accordance with the present invention. Briefly, each group of adjacent side-by-side forms is mounted on a carriage assembly above the casting bed, each carriage assembly being intercoupled with an adjacent carriage assembly to provide a plurality of carriage assemblies arranged end to end longitudinally along the bed, each carriage assembly being supported by rollers or the like so that adjacent carriage assemblies are freely moveable relative to each other within controlled limits. Removal of the crossties from their forms is accomplished by means of an apparatus having a plurality of parallel bars slidable between adjacent side-by-side crossties for lifting the crossties by contacting sloping portions of their sides, the apparatus including hydraulic jacks or the like for breaking the crossties loose from their forms prior to lifting and transporting them from the casting bed.

BRIEF DESCRIPTION OF THE DRAWING

Additional objects, advantages and novel features of the present invention may be best understood by reference to the following detailed description of an illustrative embodiment when read in conjunction with the accompanying drawings, wherein.

DETAILED DESCRIPTION OF THE PREFERRED EMBODIMENTS

Figure 1:
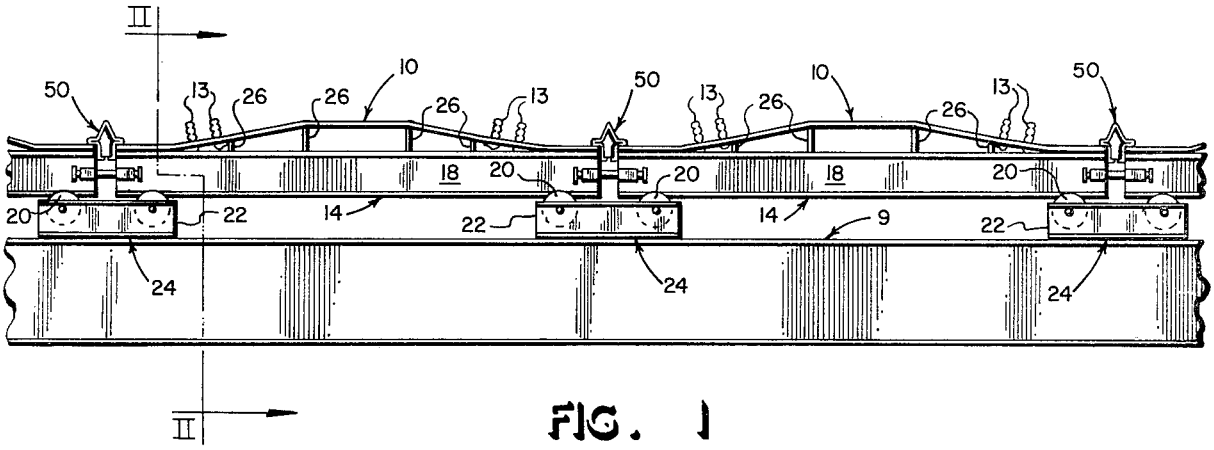
FIG. 1 is a side elevational view of a portion of a casting bed illustrating carriage-mounted forms disposed thereon for casting concrete railroad ties in inverted orientation in accordance with the inventive system.

Now referring to the drawings, an illustrative embodiment of the invention will be described in detail, like reference numerals designating like parts in the various figures.

Figure 2:
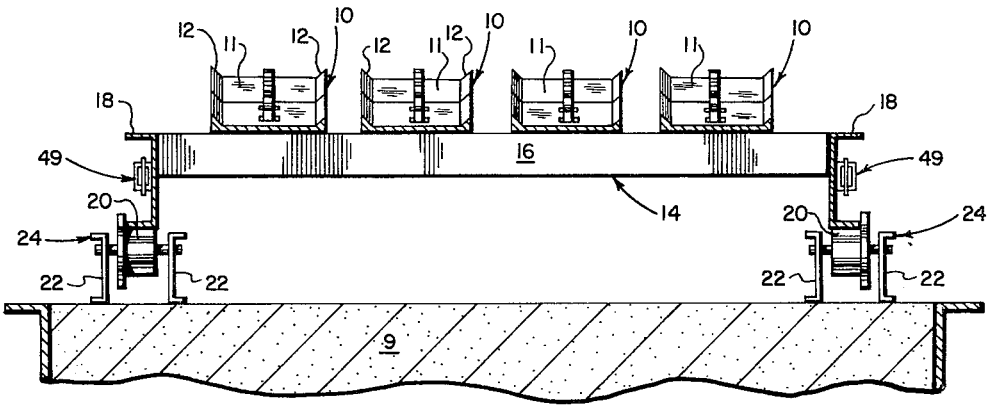
FIG. 2 is a vertical cross-section taken along line II—II of FIG. 1.

With particular reference to FIGS. 1 and 2, a system is illustrated for slip-forming concrete crossties above an elongated casting bed 9. The system includes an arrangement of casting forms 10 disposed side by side and end to end above the length of the casting bed 9. The forms 10 each have an upper surface 11 of varying height upon which the concrete crossties are cast in accordance with the invention. The upper surface 11 of each form 10 has upwardly angled edges 12 to provide chamfered corners on the crossties. In the particular example shown, the forms 10 are arranged side by side in groups of four as seen in FIG. 2. Four metal inserts 13 extend upward from the casting surface II of each form 10 as seen best in the view of FIG. 1. The inserts 13 become anchored in the concrete, as will be appreciated from the subsequent figures, to provide a means for fastening rails (not shown) to the crossties as explained in the above-referenced application.

Each group of four side-by-side forms 10 is supported by a carriage assembly, designated generally by reference numeral 14. Each carriage assembly 14 comprises a plurality of longitudinally spaced cross beams 16 secured at their ends to a C-shaped side supports 18. Each carriage assembly 14 is supported at its four corners by rollers 20, which are journaled in base members 22 situated atop the casting bed 9, the rollers 20 being flanged to prevent lateral movement of the carriages 14. It is presently preferred for ease of alignment that the rollers 20 and associated base members 22 be provided in assemblies 24 as seen in the view of FIG. 1 wherein each roller assembly 24 supports the opposed corners of adjacent carriage assemblies 14.

Each carriage assembly 14 is preferrably provided with eight of the transverse cross beams 16, two at each carriage end and six at various intermediate positions corresponding to points where the casting surfaces 11 of the superimposed forms 10 change slope. The shape of the forms 10 is dictated by the preferred shape of the upper surface of the concrete crossties, which are slip-formed in inverted orientation on the forms 10. A detailed discussion of the preferred shape of the crossties is given in the above-referenced prior application. In order to support the higher intermediate portions of the forms 10, braces 26 extend upwardly from intermediate cross beams 16 to the under surfaces of the forms 10. The braces 26 do not extend beyond the side edges of the forms 10 since that would interfere with the slip-forming process as will become apparent from the description that follows.

Figure 3:
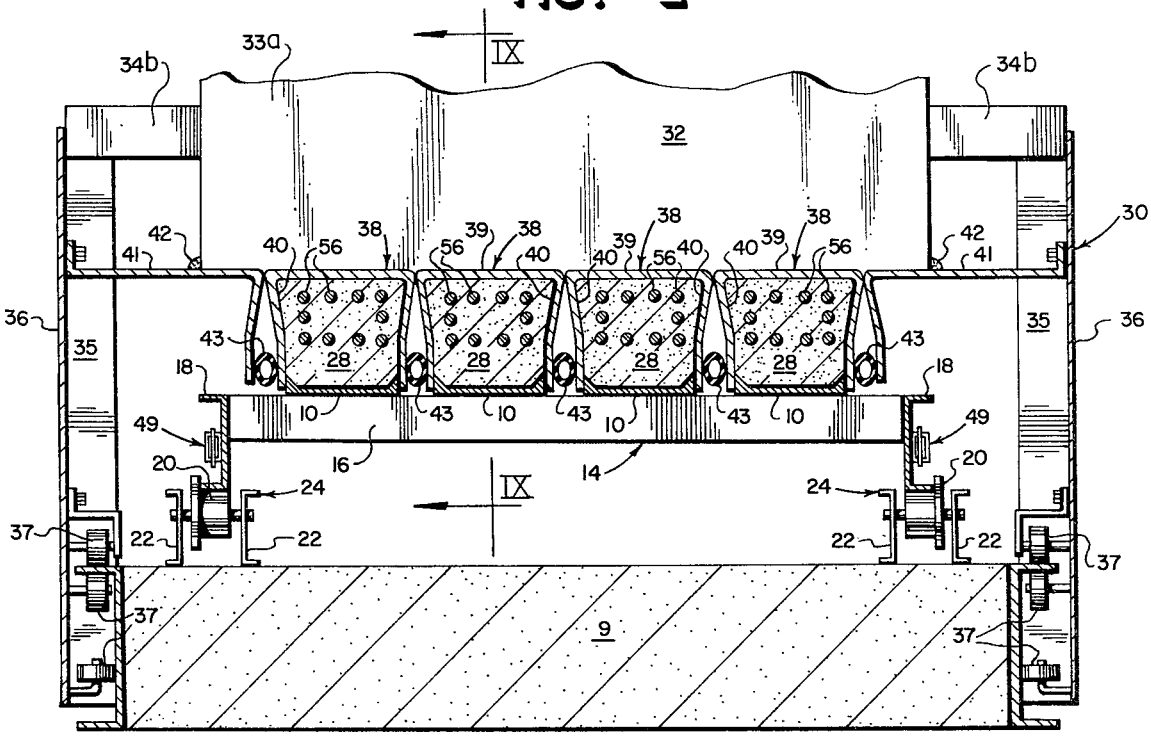
FIG. 3 is a vertical cross-section similar to FIG. 2 but with the inclusion of a continuous casting machine depicted during the inventive process of slip-forming concrete crossties, the section being taken along the line III—III of FIG. 9.
Figure 9:
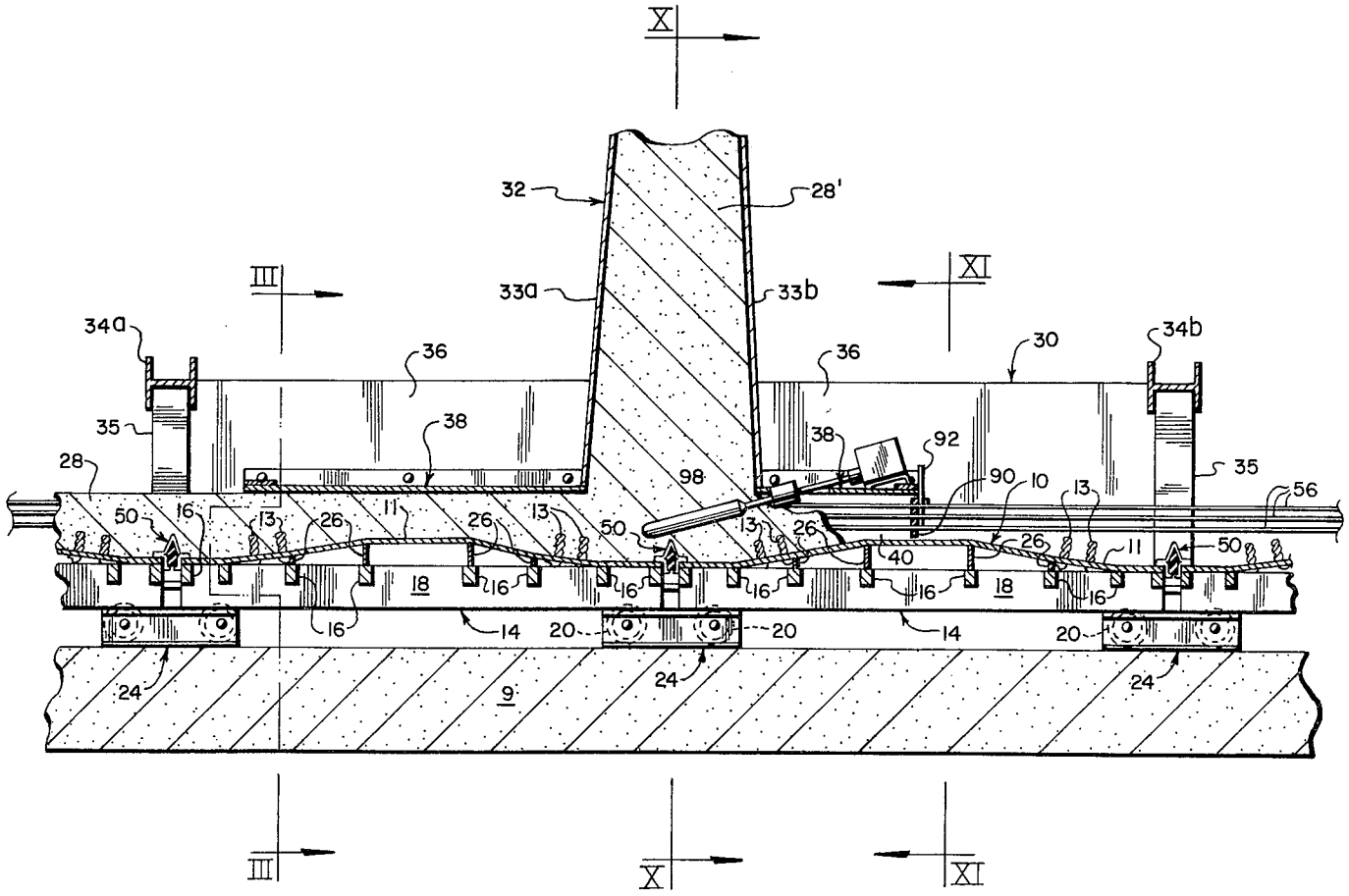
FIG. 9 is a vertical cross-section through the continuous casting machine and the underlying forms and casting bed taken longitudinally through the center of one of four pairs of end-to-end forms.

Referring now to FIG. 3, four side-by-side concrete crossties 28 are illustrated during casting by slip-forming using a specially adapted continuous casting machine, designated generally by reference numeral 30. Various details of the slip-forming process as well as certain pertinent aspects of the machine 30 are described in the above-referenced prior application. Additional details of a specially adapted machine are described below with reference to FIGS. 9–11. Referring breifly to FIG. 9 in conjunction with FIG. 3, the machine 30 includes a casting hopper 32 having a transverse dimension sufficiently wide to deposit low slump concrete 28′ on each of the side-by-side casting forms 10, which in this illustrative example number four per carriage 14. The casting hopper 32 has front and rear transverse walls 33*a* and 33*b*, which are inclined so that the width of the hopper 32 increases very slightly in moving downward to prevent concrete bridging within the hopper 32. The machine 30 has a suitable frame which is very schematically depicted as including front and rear transverse support members 34*a* and 34*b*, corner columns 35 and sidewalls 36. Rollers 37 are provided at selected points along the sidewalls 36 for supporting and guiding the machine 30 as it travels along the bed 9, the forward direction of travel being from left to right in the view of FIG. 9.

For each end-to-end string of forms 10 there is provided within the machine 30 a casting chamber conforming to the shape of the concrete crosstie 28, as best seen in the view of FIG. 3. Preferably, each casting chamber comprises a separate forming member or mold 38 having an inverted U-shape provided by a horizontal wall portion or top plate 39 and downwardly extending leg portions 40. It is presently preferred that the molds 38 be fabricated from relatively heavy gauge sheet metal, such as 0.229 inch steel plate. The molds 38 are mechanically interconnected and suspended both forwardly and rearwardly of the hopper 32 and at a precise height above the bed 9 in a suitable manner, such as by means of plates 41 extending horizontally out to the sidewalls 36, in the manner depicted. As seen clearly in FIG. 3, the corners of the cossties 28 formed at the interfaces of the top plates 39 and the respective generally vertical legs 40 are rounded, preferably with a 0.50 inch radius, to resist chipping during subsequent handling. It will be appreciated that such rounded corners would be difficult to fabricte using a prior-art wet-casting system, but are formed automatically in accordance with the present invention.

The hopper 32 can be permanently affixed to the horizontal plates 41 as indicated by the weld joints 42, or can be provided separately in suitable manner so long as a fluid tight seal is maintained at the interface between the hopper 32 and the horizontal walls 39 and plates 41.

Figure 4:
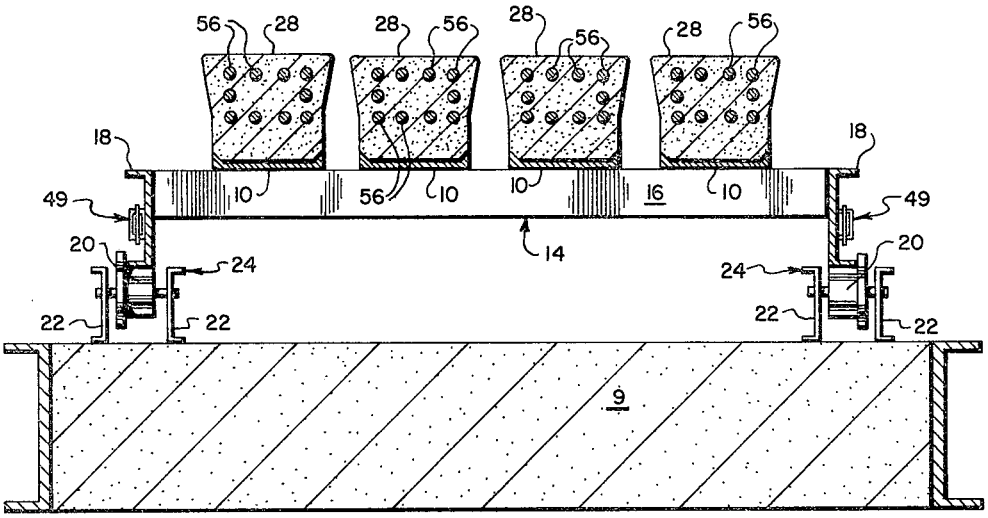
FIG. 4 is a vertical cross-section similar to FIGS. 2 and 3 at a subsequent stage of the inventive process illustrating four side-by-side crossties after slip-forming.

The downwardly extending legs 40 slidingly engage the side edges of the forms 10 as the concrete crossties 28 are slip-formed top side down on the forms 10. In accordance with a presently preferred technique, the lower portions of the legs 40 are resiliently forced against the side edges of the forms 10 by means of pneumatically operated hoses 43. The hoses 43 are controlled by connection to a common pressure source (not shown). As will be appreciated by those skilled in the art, concrete having a relatively low slump measurement must be employed so that the crossties 28 will retain their shape as depicted in FIG. 4 after the machine 30 has moved away down the casting bed 9.

An inherent advantage of the present system is that the casting of the crossties 28 is done at a relatively high level above the casting bed 9, thereby providing a relatively large open area or wash space below the carriages 14 for ease of clean-up after each casting operation.

Figure 5:
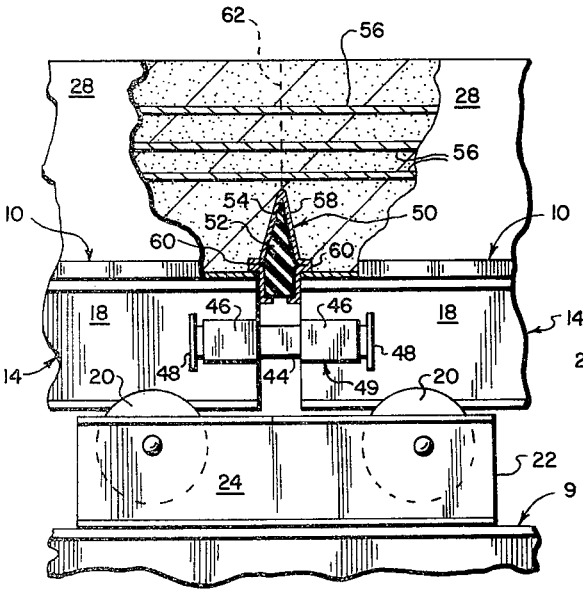
FIG. 5 is an enlarged fragmentary side view, partially in elevation and partially in section, illustrating a typical joint between ends of adjacent carriages.

In accordance with an important aspect of the invention mentioned above, the roller assemblies 24 support the opposed corners of adjacent carriages 14. FIG. 5 depicts additional details of the preferred system at a typical joint formed between the opposed ends of adjacent carriages 14. In order to keep adjacent carriages 14 in longitudinal alignment, they are coupled together on each side by a guide bar 44 slidably retained in slotted channels 46 mounted at the ends of the side supports 18 as shown. Stops 48 are secured to the ends of the guide bar 44 in order to limit the relative movement of adjacent carriages so that the ends of the carriages 14 will not travel beyond their respective rollers 20. The guide bars 44, channels 46 and stops 48 at each corner joint of adjacent carriages are collectively designated as coupling means 49 in FIGS. 2, 3, 4 and 10.

Figure 10:
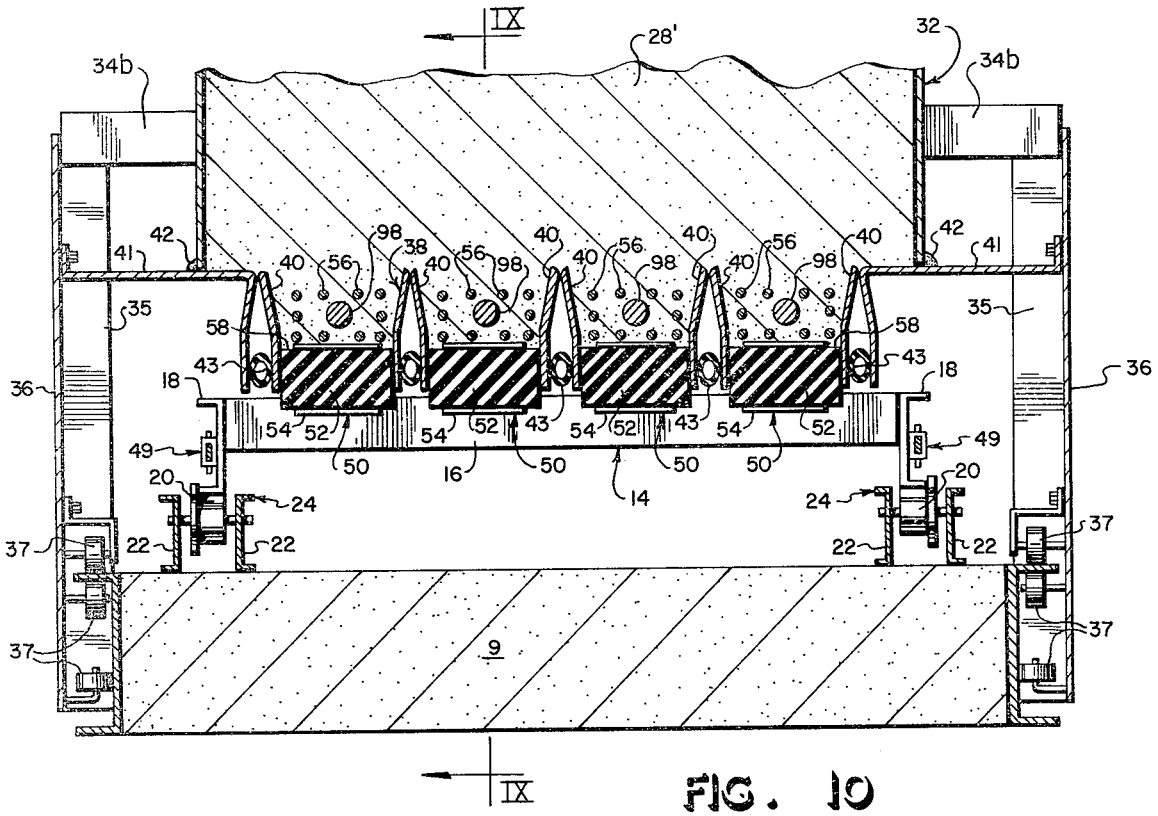
FIGS. 10 and 11 are vertical cross-sections taken respectively along lines X—X and XI—XI of FIG. 9.

In accordance with another important aspect of the invention, specially adapted spring seals 50 are disposed between the opposed ends of corresponding forms on adjacent carriages 14 as seen best in FIGS. 5 and 10. Each spring seal 50 comprises an inner elastomeric member 52 retained within a thin outer cover 54. The member 52 preferably comprises a moldable, weather-resistant rubbery polymer such as polyisoprene, polybutadiene or butadiene-styrene copolymer, but most preferably a polyisoprene such as neoprene. A pattern of strands or cables 56 is shown in the concrete, the actual number of cables 56 being variable among several different designs employed in present practice. The elastomeric members 52 are wide enough so that they will deform with ease and permit adjacent carriages 14 to move toward each other upon detensioning of the cables 56 with the resulting contraction or shortening of the concrete. Actual experience indicates that each crosstie will shorten about one-sixteenth of an inch upon detensioning. Each elastomeric member 52 tapers from its widest dimension between the ends of adjacent forms 10 to a generally pointed upper edge 58 situated just below the lowest of the cables 56. The cover 54 preferably comprises 0.062 inch thick stainless steel sheet generally conforming to the shape of the elastomeric member 52 as shown. Each side of the cover 54 is provided with a protruding lip 60 as best seen in FIG. 5 to provide a means for holding the seals 50 in place between the opposed ends of adjacent forms 10. The lateral edges of each spring seal 50 terminate flush with the edges of the forms 10 as best seen in FIG. 10 so as not to interfere with the legs 40 of the casting machine 30 while making a fluid seal for the respective casting chamber as it passes over each respective joint between the opposed ends of adjacent forms 10. The protruding lips 60, however, are preferably not flush with the edges of the forms 10 but instead are cut back slightly from the edges so that the lips 60 will lie flat against the horizontal portions of the upper surfaces 11 of the forms 10 and not ride up on the angled edges 12 (FIG. 2). It will be appreciated that the lips 60 if properly dimensioned will nest within the angled edges 12 to provide a convenient mechanism for accurate self-alignment of the lateral edges of the seals 50 with the edges of the forms 10. As an alternate means of aligning and supporting the seals 50, a single transverse member (not shown) supporting all four of the seals 50 can be mounted between the opposed ends of adjacent carriages 14, provided such a transverse supporting member is located low enough so that it would not interfere with the passing legs 40 of the casting machine 30. Such a transverse supporting member could conveniently be provided as an integral portion of the elastomeric members 52 and could conveniently be supported on the guide bars 44 of the coupling means 49.

Again referring to FIG. 5, additional aspects of the joint between adjacent carriages 14 will be described. When the concrete has gained sufficient strength, the prestressed cables 56 are detensioned at the opposite ends of the casting bed 9, thereby causing the concrete to contract by a small but significant amount. For example, in the case where thirty crossties 28 are included in each of the four continuous end-to-end strings, a contraction of about two inches occurs. This contraction occurs with a minimum of resistance from the casting forms 10 and carriages 14, since the carriages 14 with their slotted channels 46 sliding on the guide bars 44 are free to move toward each other on the rollers 20 while compressing the elastomeric members 52.

In the next stage of the process, the concrete is sawed through above the joints between carriages 14 to separate the concrete into discrete crossties 28. The dashed line 62 in FIG. 5 depicts the point at which the saw cut would be made. When the concrete is sawed through, the newly freed crossties 28 tend to bow upward and recoil slightly, thus moving a short distance from the point of the saw cut 62. The guide bars 44 are long enough to permit the carriages 14 to move longitudinally in order to compensate for such recoil action without interference from the stops 48 on the ends of the guide bars 44. In addition, the coupling provided by the guide bars 44 and slotted channels 46 tends to resist the bowing action of the crossties 28 as their ends break free, thus stabilizing the carriages 14 and keeping them in general alignment.

It will be appreciated that each spring seal 50 preferably extends upward to a point just under the lowest of the prestressed cables 56, thereby allowing the newly separated crossties 28 to pull free of each other with a clean break immediately upon sawing through the lowest of the prestressed cables 56. It has been found that when the seals 50 are not provided with a portion extending up into the concrete to just under the cables 56, the concrete tends to have an irregular break below the cables 56 caused when the concrete pulls apart as the last cable is cut through.

An additional advantage of the presently preferred construction of the spring seals 50 is that the metal cover 54 resists bending as the concrete is deposited during slip-forming. It is believed that an elastomeric member without such a cover would tend to bend out of position during slip-forming.

Figure 6:
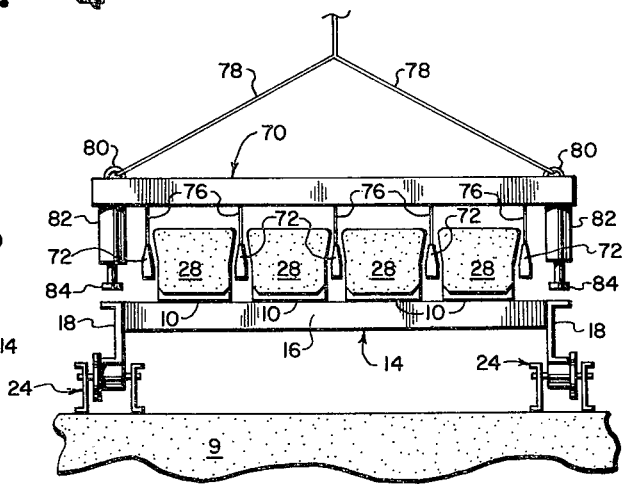
FIGS. 6–8 are end elevational views schematically illustrating the operation of a hoist apparatus during steps in a process for removing concrete crossties from their forms in accordance with the invention, the various background features being left out for sake of clarity.
Figure 7:
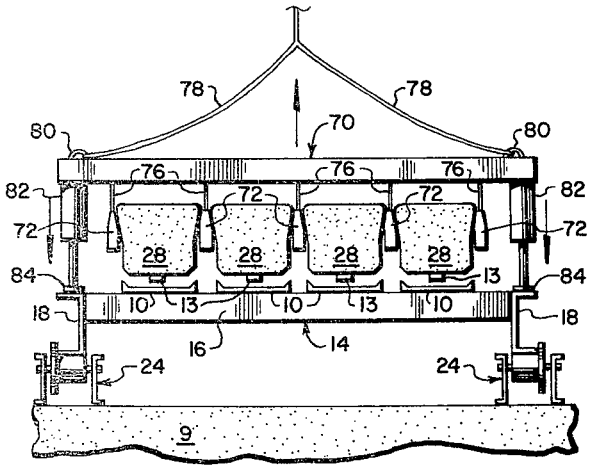
Figure 8:
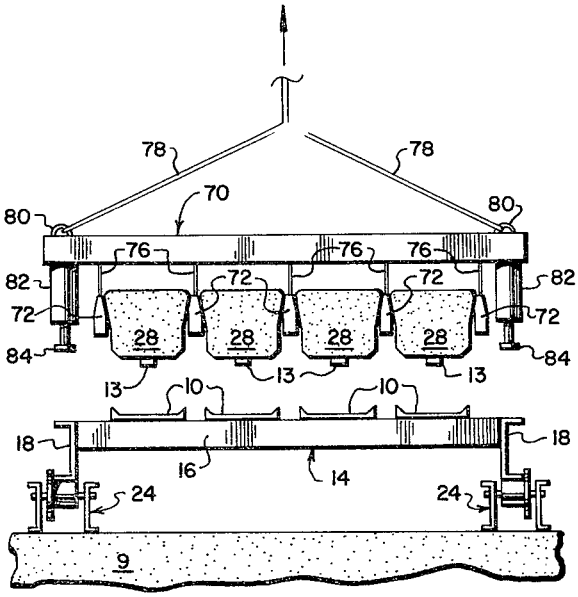

Referring now to FIGS. 6–8, an important aspect of the invention pertaining to the removal of crossties from their forms will now be described. With particular reference to FIG. 6, a hoist apparatus, designated generally by reference numeral 70, is depicted just after being positioned for engaging a group of four side-by-side crossties 28. It will be appreciated that the crossties 28 at this stage in the process have already been separated by sawing in the above-described manner at their ends from the other crossties (not shown) mass-produced in the same casting operation. It will also be appreciated that the crossties 28 have at least one free end in front of which the hoist 70 can be positioned prior to sliding it into place between and above the crossties 28 as depicted in FIG. 6. The hoist 70 is an adaptation of the similar hoist apparatus described in conjunction with FIGS. 14 and 15 in the above-referenced prior application. The presently preferred hoist 70, however, is designed to remove four side-by-side crossties 28 rather than eight as described in the prior application.

The presently preferred hoist apparatus 70 comprises five bars 72 arranged in a fork-like manner at precise lateral spacings so that the bars 72 can be inserted between each of the four crossties 28 and along the outer surfaces of the two outer crossties 28. The bars 72 are supported in parallel alignment from above by at least one brace or frame member 74 using interconnecting members 76. The hoist apparatus 70 is adapted to be lifted from above by an overhead crane (not shown) in a suitable manner, such as by means of cables 78 and eyebolts 80. The hoist 70 further comprises hydraulic jacks 82 carried by the frame 74 for purposes of aiding in releasing the crossties 28 from their respective forms 11 by means of selectively extendable rams 84 in a manner to be described more fully below.

It will, of course, be understood that the hoist 70 is intended for use with crossties having sloping side portions such as the preferred crosstie 28 illustrated herein, the dimensional details of which are described more fully in the above-referenced prior application. For best results, the surfaces of the bars 72 that engage the crossties 28 are sloped in the same manner as the sloping sides of the crossties 28. The bars 72 are wide enough so that they will engage the sloping sides of the crossties 28 when the hoist 70 is lifted upward in the manner depicted by FIG. 8. On the other hand, the bars 72 and interconnecting members 76 are narrow enough so that they will slide freely between the crossties 28 when the hoist 70 is lowered slightly into the position depicted in FIG. 6. It will be appreciated that the unique shape of the crossties 28 with their sloping sides permits the effective operation of the hoist apparatus 70 herein described.

With the hoist 70 properly positioned as depicted in FIG. 6, removal of the crossties 28 from their respective forms 10 can proceed as will now be described with particular reference to FIG. 7. First, the hoist 70 is lifted so that the bars 72 come into contact with the crossties 28. Then, the hydraulic jacks 82 are actuated to cause the rams 84 to extend down into contact with the carriage 14, preferrably at the top surfaces of the side supports 18 as shown. As the rams 84 push with increasing force on the carriage 14, the crossties 28 are soon forcibly ejected from their respective forms 10. In the presently most preferred embodiment of the hoist apparatus 70, four jacks 82 are employed (two of which are obscured from view directly behind the two explicitly shown) so that the ejecting force can be applied evenly at each of the four corners of the carriage 14. In this regard, it will be appreciated that the operation of the jacks 82 can easily be synchronized using a common hydraulic driving pump (not shown) in accordance with conventional techniques. It is also preferred that the rams 84 each have sufficient extension to be able to raise the crossties 28 at least about two inches from their forms 10, thus permitting the inserts 13 to clear the forms 10. Once the crossties 28 have been separated from their respective forms 10 in the foregoing manner, the hoist 70 can be lifted from above as depicted in FIG. 8 to facilitate transport of the group of four crossties 28 to a suitable transport car (not shown) at the side of the casting bed 9 or to a suitable nearby storage area.

From the foregoing description of the preferred casting and handling system, it will be appreciated that a number of significant improvements have been made in the state of the art of mass-producing prestressed concrete crossties. For example, the present invention eliminates the expense and complications associated with full-sided casting forms employed in conventional wet casting operations since the sides of the crossties 28 of the present invention are slip-formed using the specially adapted continuous casting machine 30.

Significant improvements over the system described in the above-referenced prior application are also disclosed herein. For example, providing casting forms 10 side by side on common carriages 14 and allowing adjacent carriages 14 to move relative to each other has reduced the incidence of damage to the forms 10 and crossties 28 and has minimized realignment problems between casting operations. In addition, the washout of concrete spillage between casting operations has been made easier due to the rather large open area provided under the carriages 14.

Another important advantage of the present invention is the elimination of bulkheads and seals between the opposed ends of adjacent crossties 28, as has been the practice in wet casting crossties end to end in full-sided molds. When a large number of crossties 28 are slip-formed in integral end to end strings in accordance with the present invention, the fact that no bulkheads are provided (except at the opposite ends of the casting bed 9) presents the problem of maintaining the prestressed cables 56 in precise predetermined positions in the crossties 28. It will be appreciated that even though tremendous tension is applied to the cables 56, there is still a small but significant sagging effect due to the weight of the cables 56 themselves. Accordingly, when a large number of crossties 28 are slip-formed end to end, the presently preferred casting machine 30 is adapted to guide the cables 56 into proper alignment just prior to their being embedded in concrete, as will presently be described.

Figure 11:
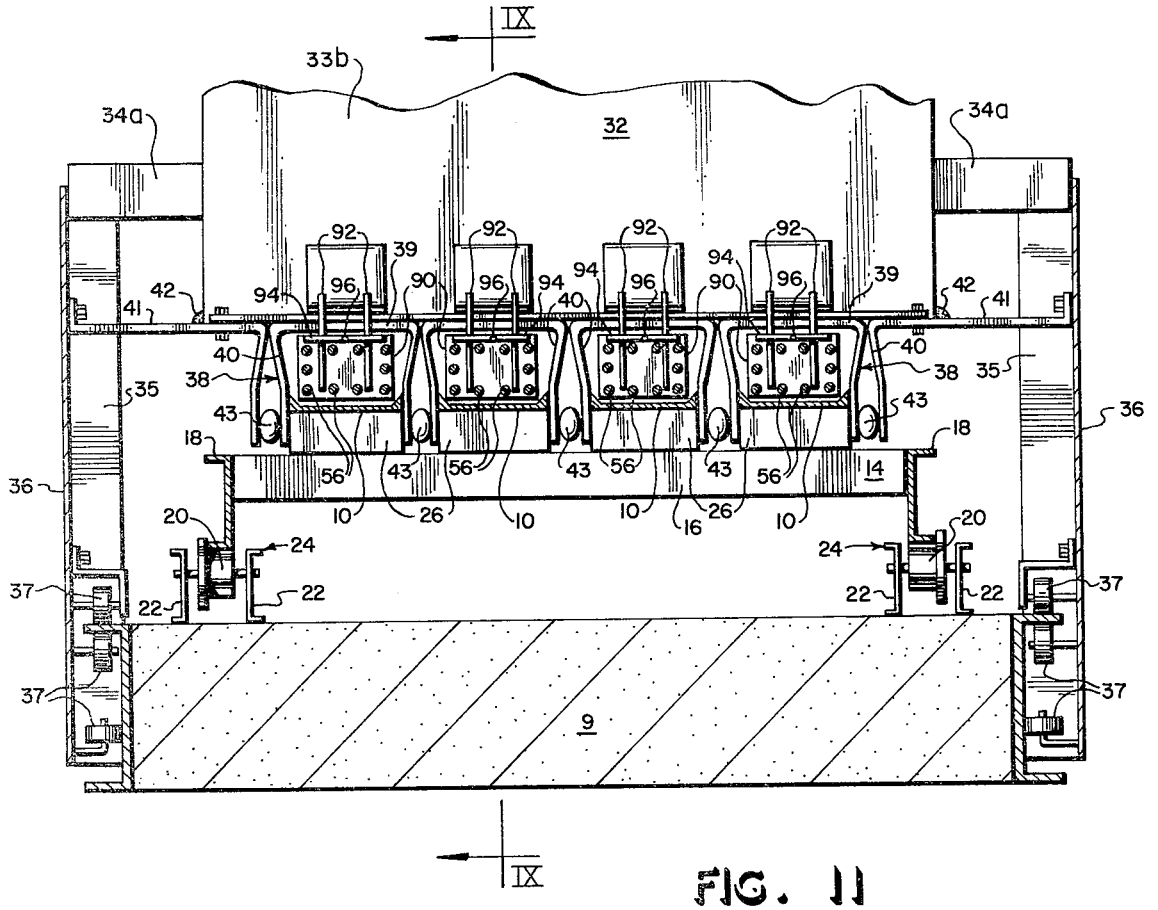

Referring now to FIGS. 9 and 11, it will be seen that the machine 30 is equipped with four guide plates 90, one for each of the four strings of crossties 28 in the particular example illustrated. Each guide plate 90 is provided with a plurality of holes in the precise pattern of the cables 56, which are strung through the holes in the manner depicted. The guideplates 90 are supported from above at a convenient position ahead of the flowing concrete 28'. Each guide plate 90 is preferrably suspended from the forward most edge of the corresponding mold 38 by means of an assembly of two vertical alignment bars 92 and an interconnecting horizontal alignment bar 94, all of which abut the guide plate 90 and push it forward as the machine 30 moves forward down the bed 9. Each guide plate 90 is maintained at a precise height by means of an insert pin 96 which extends from the horizontal bar 94 into a cooperating hole in the plate 90, as best depicted in FIG. 11. Such an arrangement permits the assemblies of the bars 92 and 94 to be removed by disengaging the insert pins 96 from the guide plates 90, thereby permitting the machine 30 to pass over the bulkheads (not shown) at either end of the casting bed 9. It will be appreciated that the guide plates 90 lift the cables 56 into proper position just prior to the cables 56 being embedded in the crossties 28 being formed to the rear thereof.

Finally, as will be appreciated from FIGS. 9 and 10, a plurality of stinger vibrators 98 are provided at the bottom of the hopper 32, preferrably one vibrator 98 per casting chamber, for locally fluidizing the relatively low slump concrete as has been previously described in the above-referenced prior application.

From the foregoing description, it will be appreciated that the present invention provides an innovative advace in the state of the art of mass-producing concrete railroad crossties. Although an illustrative embodiment of the invention has been described in detail, it is to be understood that various changes, substitutions and alterations can be made therein without departing from the spirit and scope of the invention as defined by the appended claims.

What is claimed is:

1. A system for slip-forming concrete crossties in inverted orientation on an elongated casting bed, each crosstie having a plurality of prestressed cables embedded in the concrete, the system comprising:

a plurality of casting forms arranged side by side and end to end above the casting bed, each side of each casting form being disposed in an upright plane to sealingly engage depending sides of a relatively moving slip-form casting machine;

a plurality of carriage assemblies arranged end to end above the casting bed, each carriage assembly supporting a group of side-by-side casting forms;

means for supporting the carriage assemblies while permitting relative longitudinal movement of adjacent carriage assemblies; and resilient sealing means disposed between the adjacent ends of the casting forms and forming a fluid seal therebetween, the sealing means extending to the upright planes to also form a fluid seal with the depending sides of the casting machine.

2. The system of claim 1 wherein the supporting means comprises a plurality of rollers arranged to support at least the four corners of each carriage assembly on revolving surfaces of the rollers, each roller being journaled for rotation on an axis directed transversly to the casting bed.

3. The system of claim 2 further comprising means for coupling the opposed corners of adjacent carriages to maintain the carriages in substantial longitudinal alignment while permitting relative longitudinal movement of adjacent carriages.

4. The system of claim 3 wherein the coupling means at each pair of opposed corners of adjacent carriages comprises a first channel secured at one corner of one of the carriages, a second channel secured at the opposed corner of the other carriage, the channels having longitudinally aligned slots, a guide bar slidably retained in the slots of the first and second channels, and means at the ends of the guide bar for limiting the maximum separation distance between adjacent carriages.

5. The system of claim 1 wherein each sealing member extends upward from the end edges of the respective pair of forms to a point just under the lowest of the prestressed cables.

6. The system of claim 5 wherein each sealing member comprises an inner elastomeric member retained within a thin metal cover.

7. The system of claim 6 further comprising means for supporting each sealing member in a predetermined position relative to its respective pair of forms.

8. A machine for slip-forming prestressed concrete railroad crossties on a plurality of casting forms arranged side by side and end to end above a generally horizontal casting bed, the machine comprising:

a plurality of casting chambers each having a top plate and downwardly extending legs, each chamber cooperating with an underlying casting form to slip-form a concrete railroad crosstie in inverted orientation on the casting form as the machine moves longitudinally down the casting bed, a casting hopper for depositing relatively low slump concrete into the casting chambers, means for guiding prestressed cables into the concrete in precise predetermined positions at a point just ahead of where the cables are embedded in the concrete and, pneumatically actuable means for urging the downwardly extending legs with a uniform force against cooperating edges of the respective forms to maintain an essentially fluid tight seal therebetween.

9. The machine of claim 8 further comprising means for locally fluidizing the concrete in the bottom of the casting hopper.

10. The machine of claim 8 wherein each casting chamber is provided with rounded corners at the interfaces of the top plate with each of the downwardly extending legs.

11. The machine of claim 8 wherein the top plate and downwardly extending legs of each casting chamber comprise integral portions of a single sheet-metal mold.

* * * * *